US011098534B2

(12) United States Patent
Kletzel

(10) Patent No.: US 11,098,534 B2
(45) Date of Patent: Aug. 24, 2021

(54) BIT JET ENHANCEMENT TOOL

(71) Applicant: COIL SOLUTIONS, INC., Alice, TX (US)

(72) Inventor: Robert Kletzel, Medicine Hat (CA)

(73) Assignee: Coil Solutions, Inc., Alice, TX (US)

( * ) Notice: Subject to any disclaimer, the term of this patent is extended or adjusted under 35 U.S.C. 154(b) by 0 days.

(21) Appl. No.: 16/424,306

(22) Filed: May 28, 2019

(65) Prior Publication Data

US 2019/0284880 A1 Sep. 19, 2019

Related U.S. Application Data

(63) Continuation of application No. 15/970,644, filed on May 3, 2018, now Pat. No. 10,301,883.

(60) Provisional application No. 62/500,849, filed on May 3, 2017.

(51) Int. Cl.
*E21B 12/00* (2006.01)
*E21B 21/10* (2006.01)

(52) U.S. Cl.
CPC ..... *E21B 12/00* (2013.01); *E21B 21/10* (2013.01)

(58) Field of Classification Search
CPC ..... E21B 12/00; E21B 10/60; E21B 10/38; E21B 41/0078
See application file for complete search history.

(56) References Cited

U.S. PATENT DOCUMENTS 4,819,745 A * 4/1989 Walter ..... E21B 7/18 175/107
5,230,389 A * 7/1993 Besson ..... E21B 7/18 137/813
9,932,798 B1 * 4/2018 Resendez ..... E21B 41/0078

* cited by examiner

*Primary Examiner* — Caroline N Butcher
(74) *Attorney, Agent, or Firm* — Ramey & Schwaller, LLP; William P. Ramey; Melissa D. Schwaller

(57) ABSTRACT

A bit jet enhancement tool is provided, the tool comprises two or more separate flow paths, each of the flow paths has multiple hollow chambers connected in series; each of the hollow chambers comprises a first constricted chamber with a fluid entry, a first expansion chamber located adjacent to the lower end of the first constricted chamber, a second constricted chamber with the upper end of connected to the lower end of the first expansion chamber; a separate second expansion chamber connected to the lower end of a plurality of the second constricted chambers; a single port located adjacent to the lower end of the second expansion chamber.

17 Claims, 2 Drawing Sheets

BIT JET ENHANCEMENT TOOL

RELATED APPLICATIONS

This application is a continuation of U.S. Nonprovisional Application No. 15/970,644 filed May 3, 2018, which claims the benefit of U.S. Provisional Patent Application 62/500,849 filed on May 3, 2017; which are specifically incorporated by reference in its entirety herein.

FIELD

The disclosure relates generally to delivery systems used to convert a steady fluid flow to an intermittent pulsating flow. The disclosure relates specifically to a delivery system which can provides a pulsating flow for use in between a motor and a drill or milling bit.

BACKGROUND

In the drilling of oil and gas wells as well as other downhole activities, it is common to use a downhole system which provides a percussive or hammer effect to the drill string to increase drilling rate. In typical drilling operations, a drilling fluid or mud is pumped from the surface, through the drill string and exits through nozzles in the drill bit. The fluid flow from the nozzles assists in dislodging and cleaning cuttings from the bottom of the borehole as well as carrying the cuttings back to the surface. It is also common in addition to using the pulsing apparatus to incorporate a pressure-responsive tool in the drill string which expands or retracts in response to the varying fluid pressure pulses created by operation of the pulsing apparatus. This expansion/retraction motion provides desired pulsed mud jets to assist mechanical action of a drill bit. The pulsed mud jets have significant advantages over continuous streams jets. They exert alternating loads onto the rock formation to produce a water hammer effect and high tensile stress on the formation, which will weaken the formation through the reflection of stress waves, prior to mechanical action of the drill bit, resulting in faster penetration rates. Such an apparatus may be in the form of a shock sub or tool and, may be provided above or below the pulsing apparatus or in certain cases can form part of a pulsing apparatus.

Various types of pulsing apparatuses have been employed in order to provide vibration. Some such pulsing apparatuses typically employ reciprocating impact elements that move back and forth along the axis of the pipe string to induce vibration in the pipe string. Other such pulsing apparatuses employ the use of eccentrically weighted rotating masses, eccentric shafts or rods, or rotatable impact elements that rotate about the longitudinal axis of the drill or pipe string to strike an impact anvil in order to apply a rotational or torsional vibration to the pipe string.

Still other types of pulsing apparatuses utilize Moineau power sections that are generally used in downhole mud motors or pumps. Moineau power sections typically utilize rubber or rubber-like elastomers as seals which are negatively affected by elevated wellbore temperatures and pressures, certain drilling fluids and or chemicals, and contaminants or debris in the wellbore or drilling fluids.

Apparatus utilizing one or both of these principles is described in U.S. Pat. No. 5,165,438 to David M. Facteau. Two fluidic oscillators are achieved by employing wedge-shaped splitters to route the flow of a fluid down diverging diffuser legs. The oscillators connect to a source of fluid flow, provide a mechanism for oscillating the fluid flow between two different locations within the oscillator, and emit fluid pulses downstream of the source of the fluid flow. In one vibrator, a feedback passageway from each leg is routed back to the flow path upstream of the splitter to create a condition establishing oscillating flow through the legs. In a second vibrator, a passageway between the legs downstream of the upstream end of the splitter creates a condition establishing oscillating flow through the legs. A disadvantage of this kind of oscillator is that the diverging diffuser legs required to establish oscillation are expensive to fabricate and prone to clogging from debris in the fluid because of the relative incline between the leg and the axial of the pipe string.

Consequently, there is a need to provide an even more effective fluid oscillator for drill or milling bits which is reliable, long-lived and economical.

SUMMARY

The present invention is directed to a helix oscillating delivery system that creates an erratic helical pulsating stream within a circular cylindrical structure. The helix oscillating delivery system connects to a source of fluid flow at its upper end and has a plurality of separate flow paths that are constricted and expanded repeatedly. The erratic helical pulsating stream is caused by the flow paths and strengthened by an expansion chamber.

In one embodiment, the helix oscillating delivery system comprises two or more separate flow paths. Each of the flow paths has multiple hollow chambers connected in series. Each of the hollow chambers comprises a first constricted chamber with a fluid entry, a first expansion chamber located adjacent to the lower end of the first constricted chamber, a second constricted chamber with an upper end connected to the lower end of the first expansion chamber; a separate second expansion chamber connected to the lower ends of a plurality of the second constricted chambers; and a single port located adjacent to the lower end of the second expansion chamber.

The cross-section area of the first constricted chamber is smaller than that of the first expansion chamber and the cross-section area of the first expansion chamber is larger than that of the second constricted chamber.

The cross-section area of the second expansion chamber gradually decreases from a top end to a bottom end of the second expansion chamber.

In a preferred embodiment, the shape of the cross-section of the second expansion chamber is circular, the longitudinal section of the second expansion chamber is a trapezoidal section with a large top base and a small bottom base.

In another aspect, the invention is directed to a bit jet enhancement tool, the tool comprises two or more separate flow paths, each of the flow paths has multiple hollow chambers connected in series. Each of the hollow chambers comprises a first constricted chamber with a fluid entry, a first expansion chamber located adjacent to the lower end of the first constricted chamber, a second constricted chamber with the upper end of connected to the lower end of the first expansion chamber; a separate second expansion chamber connected to the lower end of a plurality of the second constricted chambers; a single port located adjacent to the lower end of the second expansion chamber.

In one embodiment, the bit jet enhancement tool can be attached to a drilling/milling string or motor on a top side of the bit jet enhancement tool and attached to a drill bit or mill bit on a bottom end of the bit jet enhancement tool.

In one embodiment, the bit jet enhancement tool comprises a thread pin adapted to engage a threaded box of a drilling/milling string or motor, and a threaded box end to receive male threaded pin end of a bit/mill.

In another aspect, the invention is directed to a method of delivering an erratic helical jet stream within a bit jet enhancement tool connected to a drill string pipe or motor. The bit jet enhancement tool receives fluid from the drill string pipe or coil tubing into a hollow interior of the bit jet enhancement tool causing the fluid to flow through the hollow interior of the bit jet enhancement tool, where the fluid is separated into a plurality of separate paths. The fluid is repeatedly compressed and expanded creating a pulsing flow and is passed through flow chambers to create an erratic helical flow, and causing the fluid to pass out of the bit jet enhancement tool through ports in the tool to create pulsing and erratic helical jets. The bit jet enhancement tool has a plurality of separate flow paths that are alternatingly constricted and expanded to cause the fluid flowing through the bit jet enhancement tool to pulsate, the separate flow path including flows to cause the fluid flowing through the bit jet enhancement tool to pulsate in an erratic helical flow pattern, and a single port extending through the flow path of the bit jet enhancement tool on a lower end for delivering erratic helical pulsating jets of fluid out of the end for delivering erratic helical pulsating jets of fluid out of the tool.

In one embodiment, the fluid is separated into two separate paths.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3$^{rd}$ Edition.

Figure 1:
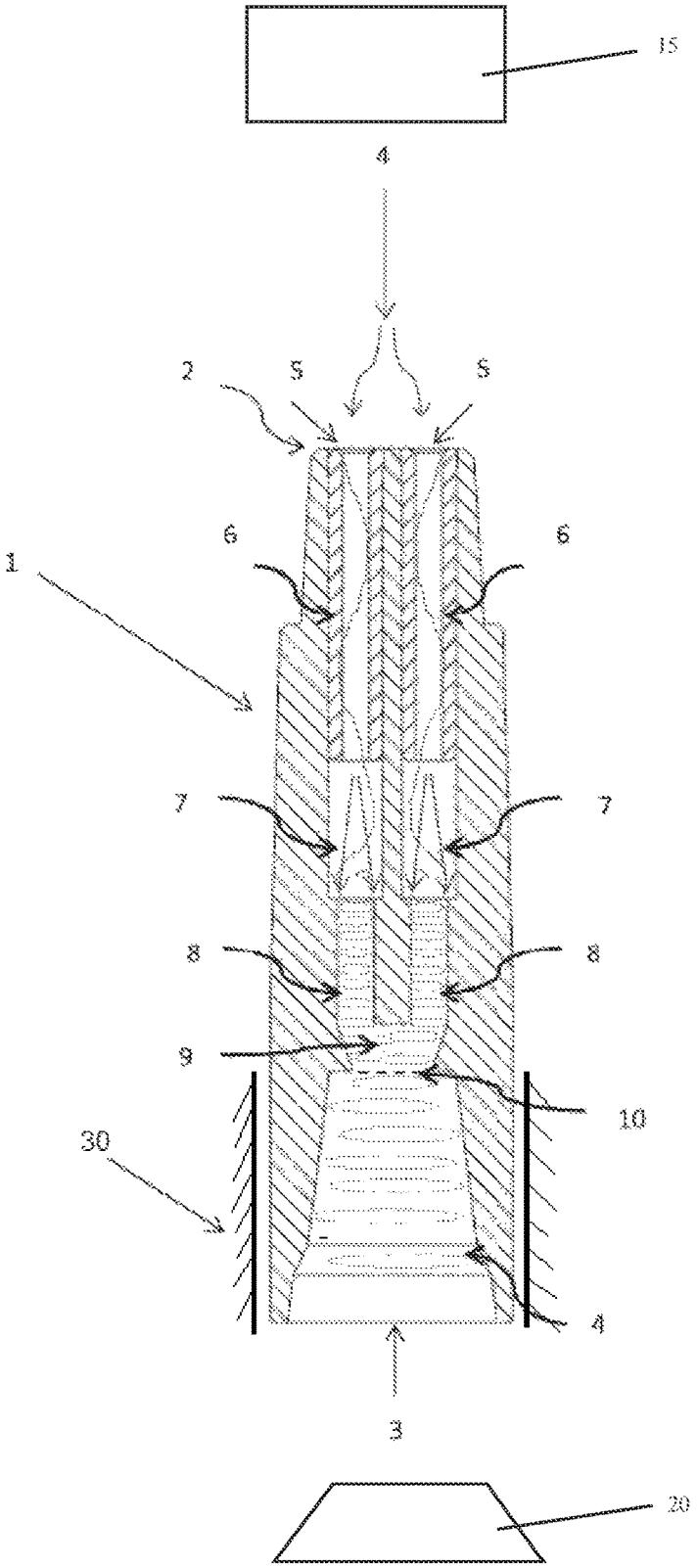
FIG. 1 is a cross-sectional view of a bit jet enhancement tool in accord with one possible embodiment of the present invention.

The present invention pertains to a helix oscillating delivery system that creates a pulsating flow within a circular cylindrical structure. The helix oscillating delivery system connects to a source of fluid flow at its upper end and has a plurality of separate flow paths that are constricted and expanded repeatedly. The flow paths enter into an expanded area and the expanded area connects to a single port on its lower end. Referring to FIG. 1, the helix oscillating delivery system comprises two or more separate flow paths 5, each of the flow paths 5 has multiple hollow chambers connected in series. For example, a flow path has a first constricted chamber 6 with a fluid entry, a first expansion chamber 7 is located adjacent to a lower end of the first constricted chamber 6. An upper end of the second constricted chamber 8 is connected to a lower end of the first expansion chamber 7. There is a separate second expansion chamber 9 connected to the lower ends of a plurality of the second constricted chambers 8 of the flow paths 5. Then a single port 10 is located adjacent to a lower end of the second expansion chamber 9. The chambers 6, 7, and 8 are columnar hollow structures and the shapes of the cross-section of the chambers are arbitrary. In some embodiments, the cross-sectional shapes can be rectangular, squares, triangular, rhomboid, and ellipse. In a preferred embodiment, the shapes of the cross-section of the chambers are circular in order to reduce the effects of resistance and drag applied to the fluid flow in the chambers.

Figure 2:
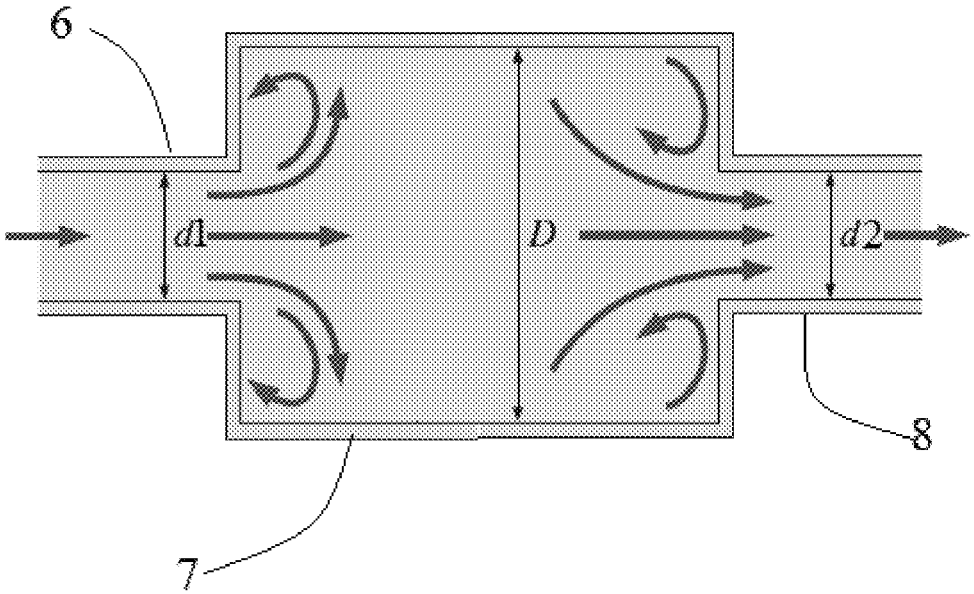
FIG. 2 is a view to show the fluid flowing in chambers of a flow path in a helix oscillating delivery system.

The cross-section area of the first constricted chamber 6 is smaller than that of the first expansion chamber 7 and the cross-section area of the first expansion chamber 7 is larger than that of the second constricted chamber 8. FIG. 2 illustrate fluid flowing in chambers 6, 7 and 8 which are connected in series. The arrows indicate the direction of the movement of the fluid. In FIG. 2, chamber 6, 7 and 8 are of cylinder shapes and have inner diameters d1, D and d2 respectively, where $d1<D$ and $D>d2$. The fluid is compressed in chamber 6 because of the restriction in flow and decrease in diameter, and the velocity of the fluid will increase. When the fluid enters into chamber 7, it will expand and the velocity of the fluid will decrease because of the increase in diameter of the chamber 7. Then when the fluid enters into chamber 8 from chamber 7, the fluid will be compressed and the velocity of it will increase, which will create a pulsing flow. The fluid near the section between chamber 6 and chamber 7 will be subject to high shear forces because of the density and viscosity of the fluid and the sudden expansion of the fluid. The shear forces cause vortex turbulence in the chamber 7. Similarly, shear forces near the section between chamber 7 and chamber 8 cause vortex turbulence in the chamber 7 because of the sudden contraction of the fluid. The vortex turbulence is propagated in the chamber 7, which induces an erratic helical flow. The erratic helical flow amplifies the pulsation of the pulsing flow.

In some embodiments, the shape of the cross-section of the expanded chamber 9 can be rectangles, squares, triangles, rhomboid, ellipse. The cross-section area of the expanded chamber 9 gradually decreases from a top end to a bottom end of it. In a preferred embodiment the shape of the cross-section of the expanded chamber 9 is circular, the longitudinal section of the expanded chamber 9 is a trapezoidal section with a large top base and a small bottom base. With this construction, the pulsing flows from a plurality of chambers 8 will expand and generate vortex turbulence which will interfuse with each other, such that the erratic helical flows from a plurality of chambers 8 will interfere with each other to generate stronger erratic helical flow. And at the same time, the fluid will be concentrated because of the gradually decreased cross-section area of the expanded chamber 9. The erratic helical flow further amplifies the pulsation of the pulsing flow in the expanded chamber 9. Then the pulsing flow is deflected and forced into the single port 10. The single port 10 can be a hollow cylinder or a conical structure with an up-narrow and down-wide configuration to form a flow path for the erratic helical pulsating stream.

As a result, a strong pulsating stream with erratic helical flow is developed in the helix oscillating delivery system without any external excitation, and no moving parts or valve arrangements are required to bring about a pulse flow.

The helix oscillating delivery system can be used in a downhole system to provide pulsation. In one embodiment, it can be used in between a motor and a drill or milling bit to form a CSI bit jet enhancement tool, the tool will be used to remove debris from the face of the milling or drilling bit and between the milling or drilling bit and the obstacle being milled or drilled.

Referring back to FIG. 1, in one embodiment, the CSI bit jet enhancement tool 1 will be attached to a drilling/milling motor 15 on a top side 2 and attached to the bit or mill 20 on a bottom end 3. The bit jet enhancement tool 1 can be used on any size bit. In another embodiment, the CSI bit jet enhancement tool 1 will be attached to a tubing string pipe on top side 2 and attached to the bit or mill 20 on the bottom end 3. The top side 2 may have male thread pin adapted to engage female threaded box of the drilling/milling motor, and the bottom end 3 may comprise female threaded box end to receive male threaded pin end of the bit or mill.

The CSI bit jet enhancement tool 1 has flow 4 entered form the top side 2 into the tool. The tool is provided internally with two or more separate flow paths 5, each of the flow paths 5 has multiple hollow chamber connected in series. A flow path 5 has a first constricted chamber 6 with a fluid entry, a first expansion chamber 7 is located adjacent to a lower end of the first constricted chamber 6. An upper end of the second constricted chamber 8 is connected to a lower end of the first expansion chamber 7. Fluid flow 4 is alternatingly constricted in chamber 6, then expanded in chamber 7 and then constricted in chamber 8 to cause itself to pulsate in a flow pattern with erratic helical flow. The flow 4 from the chamber 8 enters into the second expansion chamber 9 and is forced into the single port 10 extending through the bit jet enhancement tool 1 on a lower end for delivering erratic helically pulsating jets of fluid out of the tool.

In one embodiment, the fluid in the bit jet enhancement tool 1 is water-based fluid. The base fluid may be fresh water, seawater, brine, or a saturated brine. The type of fluid selected depends on anticipated well conditions or on the specific interval of the well being drilled.

In another embodiment, the fluid in the bit jet enhancement tool 1 is oil-based fluid which comprises diesel, mineral oil, or low-toxicity linear olefins and paraffins. The fluid can help to remove cuttings from the wellbore 30, control formation pressures and maintaining hole stability.

Another aspect of the current invention is a method of delivering an erratic helical pulsating jet stream within a bit jet enhancement tool connected to a drill string pipe or motor, so that the tool receives fluid from the drill string pipe or coil tubing into a hollow interior of the tool. Referring back to FIG. 1, the fluid is separated into two or more separate flow paths 5, causing the fluid to be repeatedly compressed and expanded, which will create a pulsating flow with erratic helical flow, and causing the pulsating flow to pass out of the tool through ports in the tool to create pulsing and erratic helical jets of fluid. The bit jet enhancement tool is provided internally with two or more separate flow paths 5 that are repeatedly compressed and expanded to cause the fluid to pulsate in an erratic helical flow pattern. Each of the flow paths 5 has multiple hollow chamber connected in series. A flow path 5 has a first constricted chamber 6 with a fluid entry, a first expansion chamber 7 is located adjacent to a lower end of the first constricted chamber 6. An upper end of the second constricted chamber 8 is connected to the lower end of the first expansion chamber 7. Fluid flow 4 is alternatingly constricted in chamber 6, then expanded in chamber 7 and then constricted in chamber 8 to cause itself to pulsate in a flow pattern with erratic helical flow. The flow from the chamber 8 enters into the second expansion chamber 9 and is forced into the single port 10 extending through the bit jet enhancement tool 1 on a lower end for delivering erratic helically pulsating jets of fluid out of the tool.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. More specifically, it will be apparent that certain agents which are both chemically related may be substituted for the agents described herein while the same or similar results would be achieved. All such similar substitutes and modifications apparent to those skilled in the art are deemed to be within the spirit, scope and concept of the disclosure as defined by the appended claims.

What is claimed is:

1. A bit jet enhancement tool, comprising:

a plurality of flow paths, wherein each of the plurality of flow paths includes:

a first constricted chamber with a fluid entry;

a first expansion chamber located adjacent to a lower end of the first constricted chamber;

a second constricted chamber with an upper end of the second constricted chamber connected to a lower end of the first expansion chamber;

a second expansion chamber connected to a lower end of the second constricted chamber;

a top side and a bottom side; and, a single port located adjacent to a lower end of the second expansion chamber;

wherein a cross-section area of the second expansion chamber gradually decreases from a top end to a bottom end thereof, wherein the bottom side has a threaded box.

2. The bit jet enhancement tool of claim 1, wherein the plurality of flow paths comprises two separate flow paths.

3. The bit jet enhancement tool of claim 1, wherein the cross-section of the second expansion chamber is of a circular shape.

4. The bit jet enhancement tool of claim 1, wherein the single port is a hollow cylinder or a hollow-conical structure.

5. The bit jet enhancement tool of claim 1, wherein the single port includes a first width proximate the second expansion chamber and a second width spaced apart from the first width, wherein the first width is smaller than the second width.

6. The bit jet enhancement tool of claim 1, further comprising a) a top side with a threaded box configured to receive a threaded pin of a bottom hole assembly or b) a bottom end with a threaded pin wherein the threaded pin is configured to be received in a threaded box of one of a tubing and a motor.

7. The bit jet enhancement tool of claim 1, wherein each of the plurality of flow paths are configured such that when a fluid flows through the bit jet enhancement tool the fluid flows sequentially through the first constricted chamber, the first expansion chamber, the second constricted chamber, and the second expansion chamber.

8. The bit jet enhancement tool of claim 1, wherein the first constricted chamber and the first expansion chamber are configured such that when a fluid flows through the bit jet enhancement tool the fluid flow becomes turbulent upon entering the first expansion chamber from the first constricted chamber.

9. The bit jet enhancement tool of claim 1, wherein the first expansion chamber and the second constricted chamber are configured such that when a fluid flows through an extended reach tool a portion of the fluid flow within the first expansion chamber becomes turbulent as another portion of the fluid flow exits the first expansion chamber and enters the second constricted chamber.

10. The bit jet enhancement tool of claim 1, wherein the first constricted chamber, the first expansion chamber, and the second constricted chamber are configured such that when a fluid flows through the bit jet enhancement tool a portion of the fluid within the first expansion chamber becomes turbulent and propagates through the first expansion chamber.

11. The bit jet enhancement tool of claim 1, wherein a cross-section of at least one of the first constricted chamber, the first expansion chamber, and the second constricted chamber of at least one of the at least two separate flow paths, and the second expansion chamber is one of a columnar hollow shape, a rectangular shape, a square shape, a triangular shape, a rhomboidal shape, an elliptical shape, and a circular shape.

12. The bit jet enhancement tool of claim 1, wherein a longitudinal section of the second expansion chamber is a trapezoidal section.

13. The bit jet enhancement tool of claim 12, wherein the trapezoidal section includes a top base proximate the top of the second expansion chamber and a bottom base proximate the bottom of the second expansion chamber, wherein the top base is longer than the bottom base.

14. The bit jet enhancement tool of claim 1, wherein the second expansion chamber and each second constricted chamber of the at least two flow paths are configured such that when a fluid flows through the bit jet enhancement tool a portion of the fluid flow within each of second constricted chamber enters the second expansion chamber, thereby causing the flow of fluid to become turbulent within the second expansion chamber and amplify a pulsation of the fluid flowing through the second expansion chamber.

15. The bit jet enhancement tool of claim 1, wherein:

the first constricted chamber includes a first constricted chamber diameter;

the first expansion chamber includes a first expansion chamber diameter, wherein the first expansion chamber diameter is greater than the first constricted chamber diameter; and, the second constricted chamber includes a second constricted chamber diameter, wherein the first expansion chamber diameter is greater than the second constricted chamber diameter.

16. A method of delivering a pulsing fluid, comprising:

positioning the bit jet enhancement tool of claim 1 in a well bore;

providing a fluid to the bit jet enhancement tool;

separating the fluid into the plurality of flow paths in the bit jet enhancement tool.

17. A drill string comprising:

at least one of a tubing and a motor;

a bottom hole assembly; and, the bit jet enhancement tool of claim 1.

* * * * *